US007387528B2

(12) United States Patent
Lee et al.

(10) Patent No.: US 7,387,528 B2
(45) Date of Patent: Jun. 17, 2008

(54) CONNECTOR FOR FLEXIBLE PRINTED CIRCUIT BOARD

(75) Inventors: Shih-An Lee, Taipei Hsien (TW); Chung-Hsin Huang, Taipei Hsien (TW); Yung-Chi Peng, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 449 days.

(21) Appl. No.: 11/159,931

(22) Filed: Jun. 23, 2005

(65) Prior Publication Data

US 2006/0292910 A1 Dec. 28, 2006

(51) Int. Cl.
*H01R 12/24* (2006.01)

(52) U.S. Cl. ..... 439/495; 439/492; 439/499; 439/260; 439/267

(58) Field of Classification Search ..... 439/260, 439/495, 492, 329, 267, 67, 372, 142, 499, 439/596
See application file for complete search history.

(56) References Cited

U.S. PATENT DOCUMENTS 6,056,571 A * 5/2000 Noro ..... 439/260
6,267,620 B1 * 7/2001 Ma ..... 439/495
6,338,648 B1 * 1/2002 Miura et al. ..... 439/495
6,679,713 B2 * 1/2004 Miura ..... 439/260
6,893,288 B2 * 5/2005 Tsunematsu ..... 439/495
2002/0106924 A1 8/2002 Uehara
2003/0092310 A1 * 5/2003 Kunishi et al. ..... 439/495

* cited by examiner

*Primary Examiner*—Renee S Luebke
*Assistant Examiner*—Vanessa Girardi

(57) ABSTRACT

A flexible printed circuit board connector includes a housing, a sliding cover and a pair of support nails. A pair of guiding grooves and a pair of insertion holes are defined in sidewalls of the housing for receiving the support nails. A protruding portion is formed on each support nail to form a pivotal hole between the protruding portion and inner surfaces of the groove. The sliding cover has a pair of cam shafts rotatably supported in the pivotal holes. The cross section of each cam shaft has an utmost protrudent point which brushes past an inner surface of the pivotal hole when flipping the sliding cover. The length of the longest chord of the cross section that passes the utmost protrudent point is longer than the distance between the inner surface brushed by the utmost protrudent point and its opposite inner surface of the pivotal hole. To flip down the sliding cover, a considerable force is needed to overcome the interference between the utmost protrudent point and the inner surfaces of the pivotal hole. Therefore, the sliding cover is prevented from being accidentally turned over.

3 Claims, 9 Drawing Sheets

CONNECTOR FOR FLEXIBLE PRINTED CIRCUIT BOARD

BACKGROUND OF THE INVENTION

1. Field of the Invention

The present invention relates to a flexible printed circuit board connector, especially to a flexible printed circuit board connector with a sliding cover capable of facilitating the insertion/release of a flexible printed circuit board therein/therefrom.

2. The Related Art

Nowadays, flexible printed circuit boards are widely applied in many kinds of electrical devices due to their high flexibility and thin structure. Accordingly, connectors for connecting the FPC boards to other electrical components of the electrical devices are mass-employed.

One example of the connectors of the prior art is disclosed in U.S. Pat. Publication No. 2002/0106924 published on Aug. 8, 2002. The flexible printed circuit board connector has a block and a slider mounted on the block to define a space for receiving a printed circuit board. The connector further has a plurality of terminals disposed in the block and extended into the space for electrically connecting the printed circuit board. The slider is provided with locking portions at its front end and shaft portions at its rear end. The block is provided with anchoring portions at its front end to engage with the locking portions. The block is further provided with bearing portions at its rear end for rotatably supporting the shaft portions, thereby enabling the slider to be pivotal between an open position where it permits the printed circuit board to be inserted/released into/from the connector and a closed position where the locking portions engage with the anchoring portion to lock the slider to the block. In the closed position, the printed circuit board can be locked between the slider and the block.

However, the bearing portions and the shaft portions are designed that the shaft portions can be freely rotated in the bearing portions. When the slider is lifted to the open position to insert or release the flexible printed circuit board, the slider may be flipped down due to accidental hit on the slider, which disturbs the insertion or release operation and more badly makes the operator have to do the operation again.

Hence, an improved flexible printed circuit board connector is required to overcome the disadvantages of the prior art.

SUMMARY OF THE INVENTION

An object of the present invention is to provide a flexible printed circuit board connector with a sliding cover designed to be able to prevent the sliding cover from being accidentally turned over while inserting/releasing the flexible printed circuit board into/from the connector, thereby facilitating the insertion/release operation.

To fulfil the above mentioned object, the present invention provides a flexible printed circuit board connector. The flexible printed circuit board connector includes a housing, a plurality of terminals disposed in the housing, a sliding cover and a pair of support nails. The housing has a base plate, a bottom plate extending from the bottom of the base plate and two sidewalls extending forward from two opposite sides of the base plate, which define a board-insertion space for an external flexible printed circuit board being inserted therein. Two guiding grooves are defined in inner sides of the two sidewalls. Two insertion holes are defined in the two sidewalls and communicate with the respective guiding grooves. The sliding cover has two cam shafts at two opposite sides thereof. The sliding cover is mounted on the housing by sliding the two cam shafts in the guiding grooves and for pressing on the printed circuit board. Each of the supporting nails has a protruding portion and is inserted in the corresponding insertion hole with the protruding portion extending into the corresponding guiding groove to form a pivotal hole between inner surfaces of the guiding groove and the protruding portion. The cam shafts are enclosed and rotatably supported in the respective pivotal holes. The cross section of each cam shaft has an utmost protrudent point which brushes past an inner surface of the corresponding pivotal hole when flipping the sliding cover. The length of the longest chord of the cross section that passes the utmost protrudent point is longer than the distance between the inner surface brushed by the utmost protrudent point and its opposite inner surface of the pivotal hole.

As the cam shaft is structured as mentioned above, there exists interference between the utmost protrudent point and the inner surfaces of the pivotal hole. To flip the sliding cover, an intended considerable force is needed to overcome the interference. While the sliding cover is flipped up for the flexible printed circuit board being inserted/released into/from the connector, an accidental hit on the sliding cover will not cause the sliding cover to flip down. Therefore, the sliding cover is prevented from being accidentally turned over while inserting/releasing the flexible printed circuit board into/from the connector, thereby facilitating the insertion/release operation.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
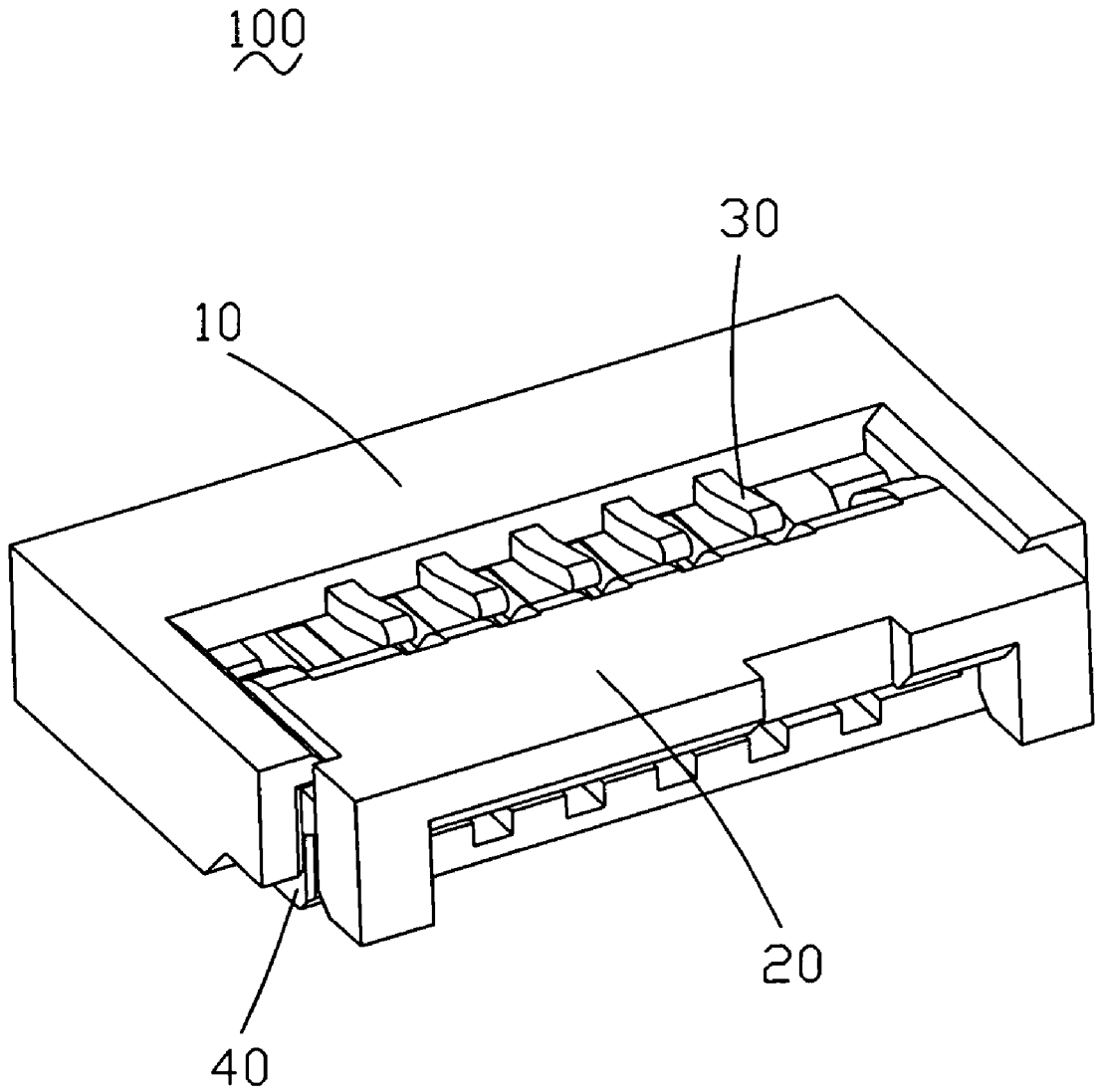
FIG. 1 is an assembled perspective view of a flexible printed circuit board connector in accordance with the present invention.
Figure 2:
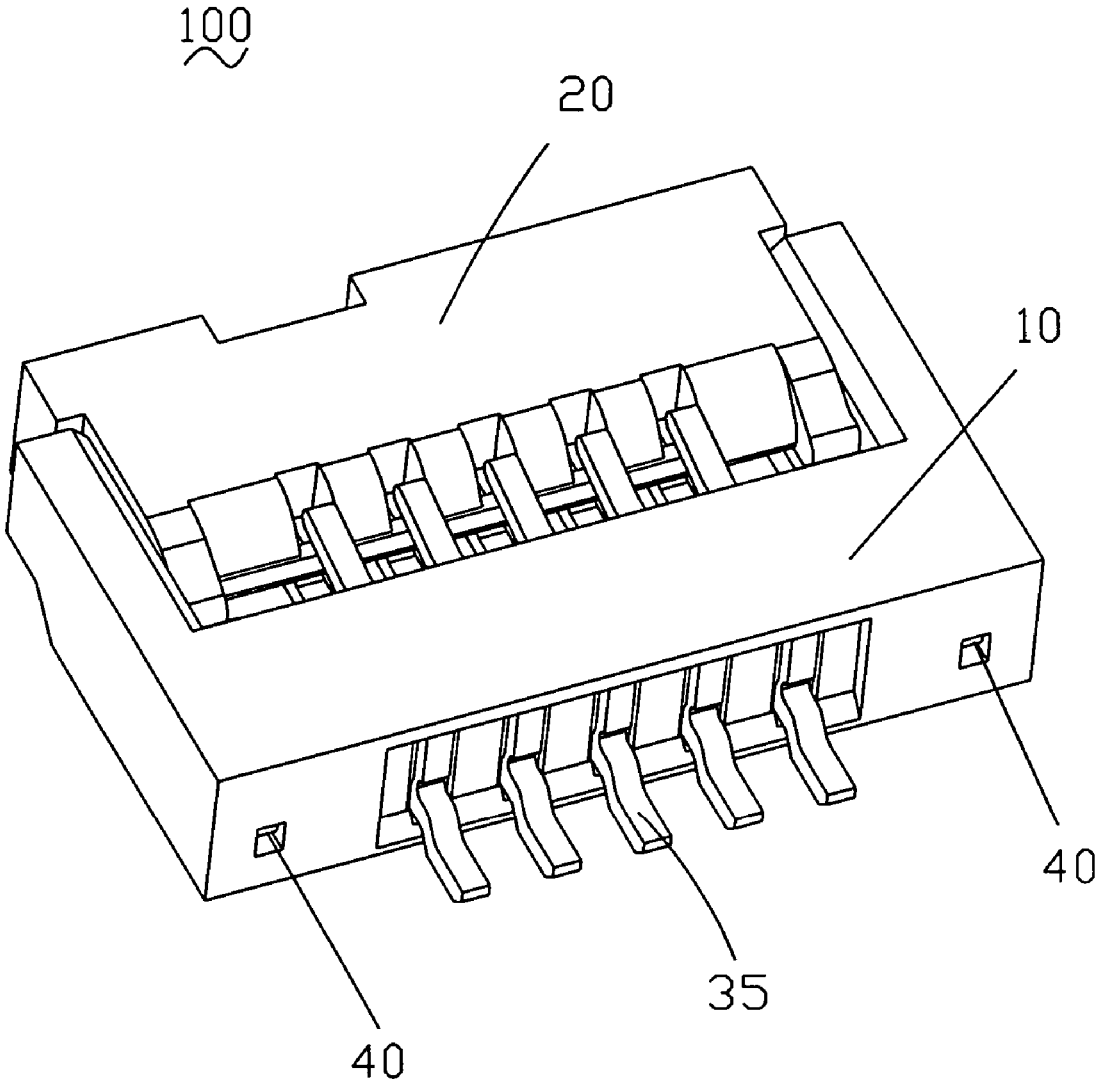
FIG. 2 is another assembled perspective view of the flexible printed circuit board connector of FIG. 1.

Referring to FIGS. 1 and 2, the flexible printed circuit connector 100, according to the present invention, comprises a housing 10, a sliding cover for engaging with the housing 10. A plurality of terminals 30 and a pair of support nails 40 are received in the housing 10.

Figure 3:
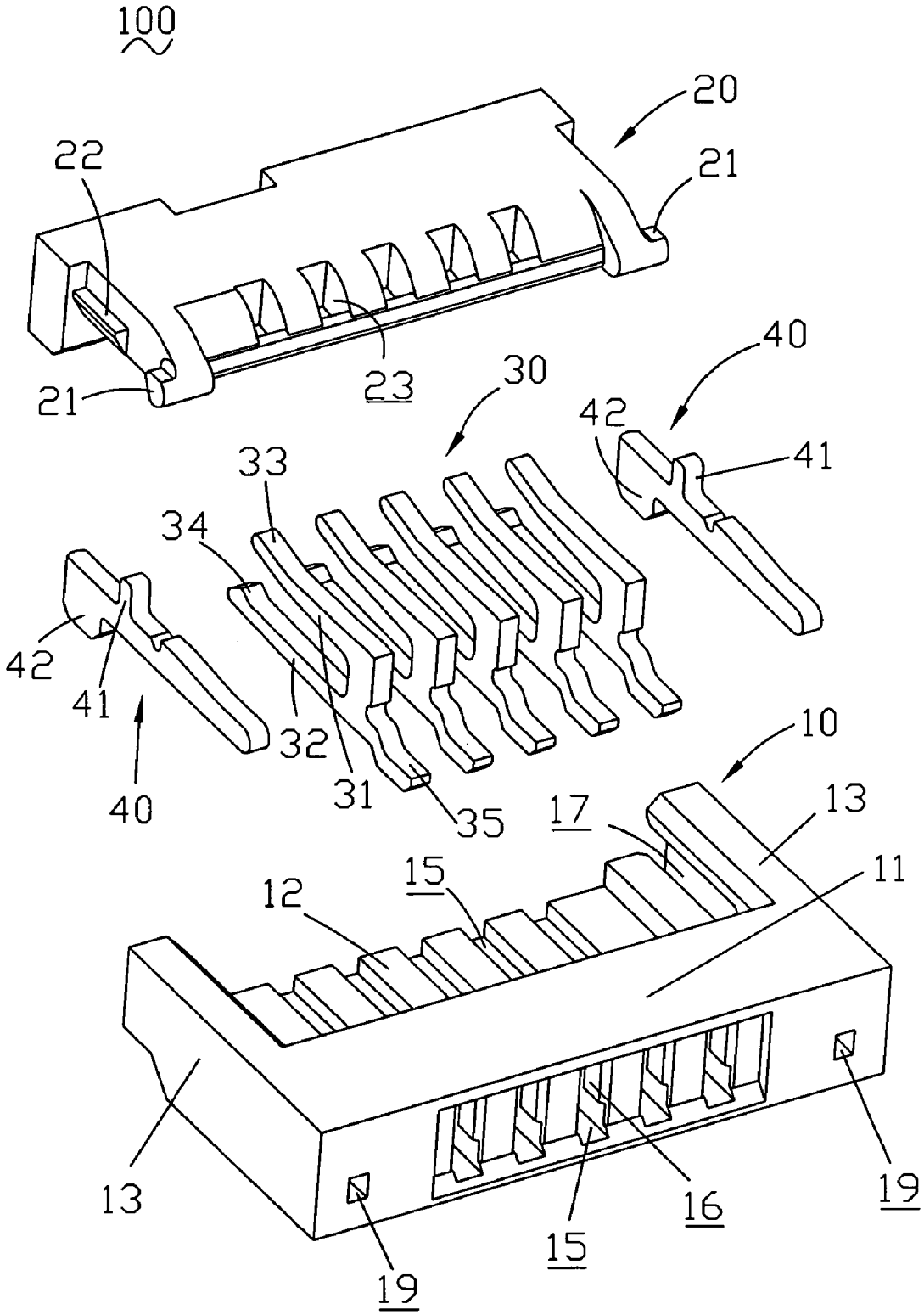
FIG. 3 is an exploded perspective view of the flexible printed circuit board connector of FIG. 2.
Figure 4:
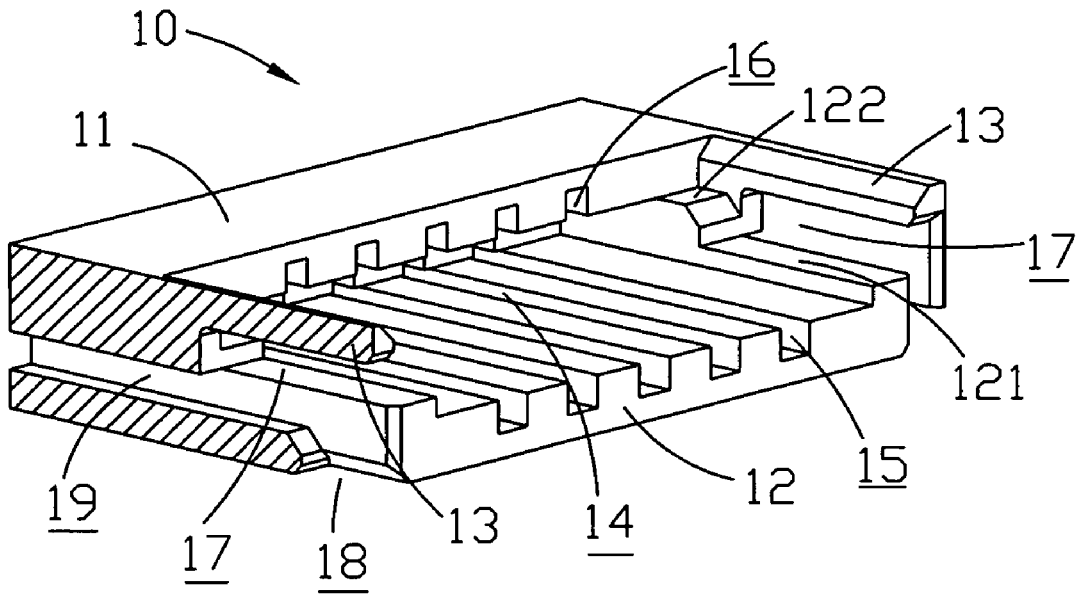
FIG. 4 is a perspective view of a housing of the flexible printed circuit board connector with one end of the connector shown in cross-section.

Referring to FIGS. 3 and 4, the housing 10 has a base plate 11, a bottom plate 12 protruded forward from the bottom of the base plate 11 and a pair of sidewalls 13 extending forward from the two opposite sides of the base plate 11, which define a board-insertion space 14 for an external flexible printed circuit board being inserted therein. A pair of guiding tracks 121 is extended at two opposite sides of the bottom plate 12. A pair of stopping blocks 122 is protruded at back of the two guiding tracks 121. A plurality of first terminal recesses 15 is defined in the bottom plate 12 and a plurality of second terminal recesses 16 is formed in the base plate 11. Each of the first terminal recesses 15 is communicated with the corresponding second terminal recess 16. The first and the second terminal recesses 15, 16 further extend through the base plate 11, as shown in FIG. 3. A guiding groove 17 defined in the inner side of the front portion of each sidewall 13. An insertion hole 19 in defined in each sidewall 13 and extends through the sidewall 13 and the base plate 11. Each insertion hole 19 communicates with the respective guiding groove 17. A soldering notch 18 is formed in the bottom of the front portion of each sidewall 13. Each soldering notch 18 communicates with the corresponding insertion hole 19.

Figure 5:
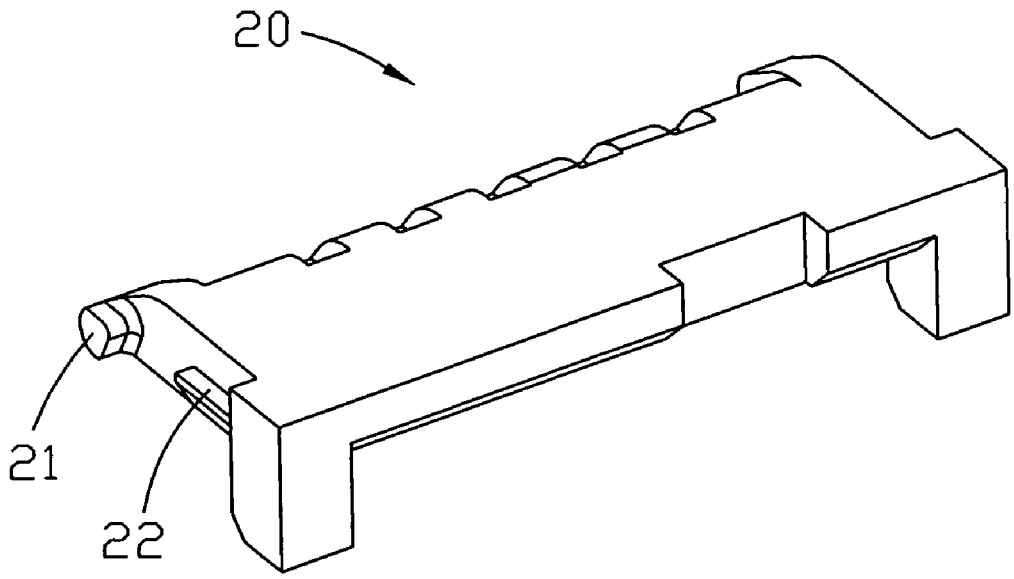
FIG. 5 is a perspective view of a sliding cover of the flexible printed circuit board connector.

Referring to FIGS. 3 and 5, the sliding cover 20 has a pair of cam shafts 21 protruded outward from the back portion of both sides of the sliding cover 20. A wedge 22 is protruded outward on the middle of each side of the sliding cover 20. A plurality of propping recesses 23 is formed on the top and back of the sliding cover 20.

Referring to FIG. 3, each terminal 30 shaped like a tuning fork has an upper arm 31, a lower arm 32 and a tail portion 35. The front end of each upper arm 31 is bent upwardly to form a propping portion 33. The front end of each lower arm 32 is protruded upwardly to form a contact portion 34. Each support nail 40 has a protruding portion 41 protruded upwardly on the nearly middle part thereof and a soldering portion 42 extended downwardly from the front portion of the support nail 40.

Figure 6:
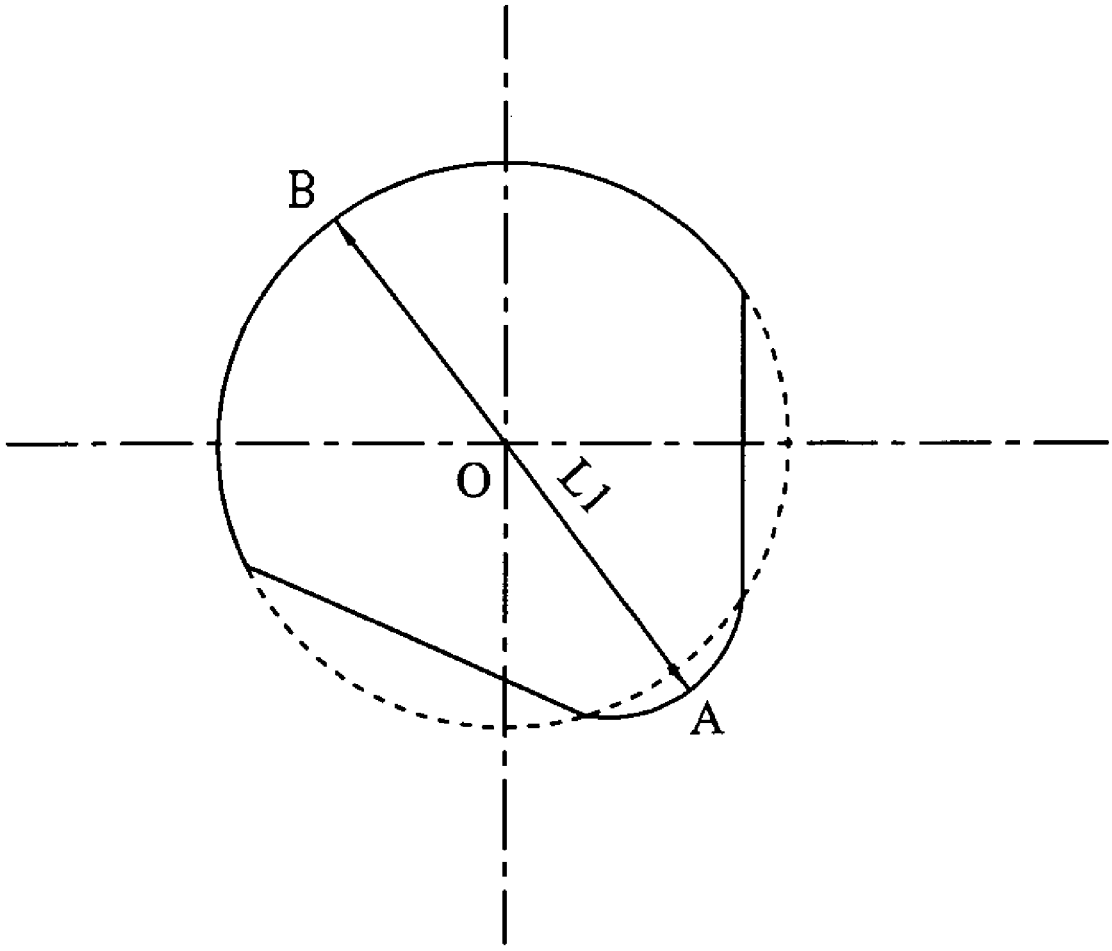
FIG. 6 illustrates a cross section of a cam shaft of the sliding cover as shown in FIG. 5.
Figure 7:
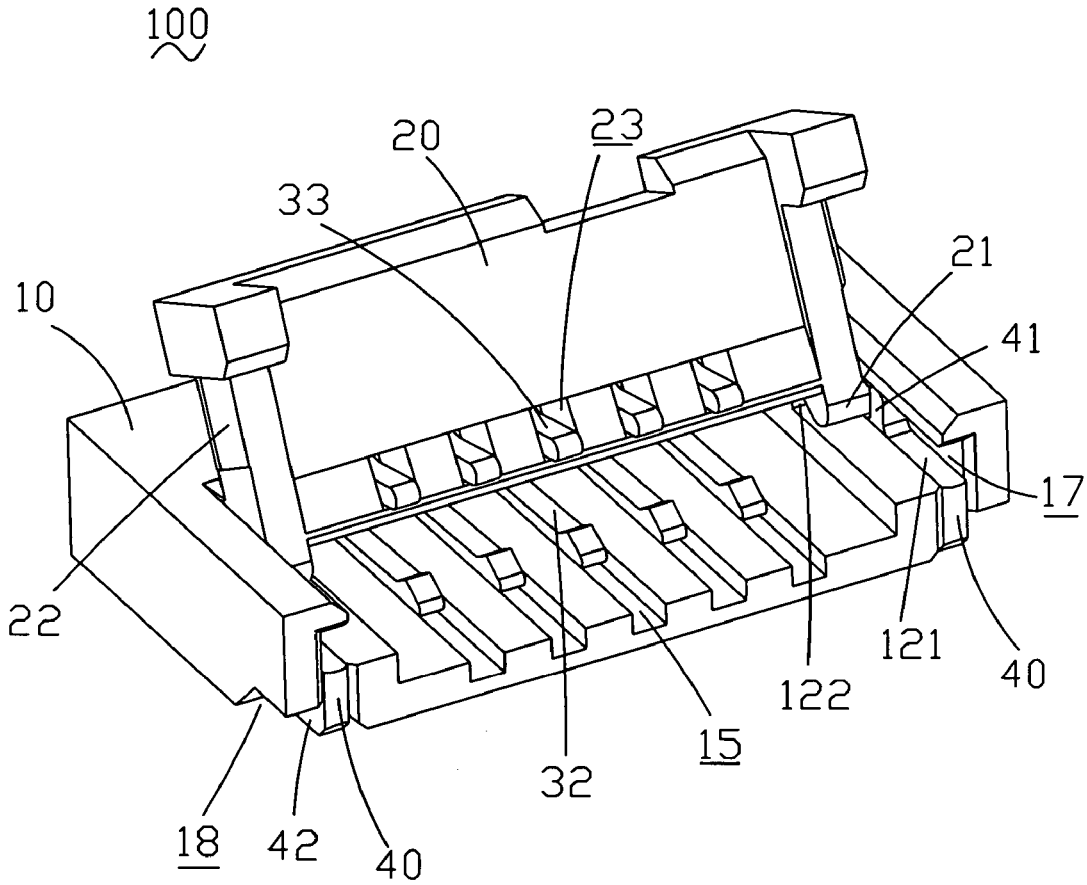
FIG. 7 is a perspective view of the flexible printed circuit board connector with the sliding cover being flipped up.
Figure 8:
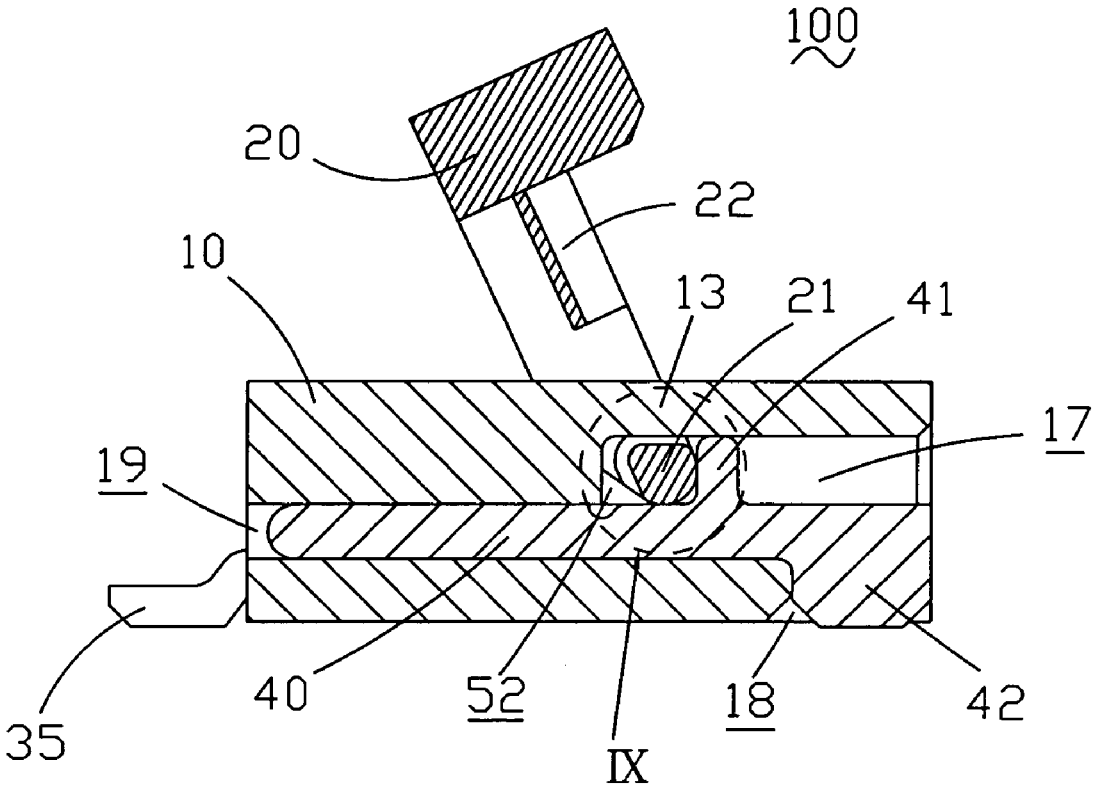
FIG. 8 is a cross-sectional view of FIG. 7.

With reference to FIGS. 6 and 7, in assembly, the upper arms 31 and the lower arms 32 of the terminals 30 are respectively received in the second terminal recesses 16 and the first terminal recesses 15 of the housing 10. The tail portions 35 of the terminals 30 extend outward from the rear of the base plate 11. The cam shafts 21 of the sliding cover 20 are inserted into the guiding grooves 17 of the housing 10. The sliding cover 20 is pushed forward with the cam shafts 21 sliding along the guiding tracks 121 and the guiding grooves 17 until the cam shafts 21 are stopped by the stopping blocks 122 of the housing 10. The propping portions 33 of the upper arms 31 extend into the propping recesses 23 of the sliding cover 20 for urging the sliding cover 20 against the external flexible printed circuit board. The support nails 40 are inserted into the insertion holes 19 with the protruding portions 41 extending into the respective guiding grooves 17 and the top surfaces of the protruding portions 41 contacting with the inner top surfaces of the corresponding guiding grooves 17 further to form a pair of pivotal holes 52 between inner surfaces of the guiding grooves 17 and the protruding portions 41, as shown in FIG. 8. Thereafter, the cam shafts 21 of the sliding cover 20 are enclosed and rotatably supported in the corresponding pivotal holes 52. The soldering portions 42 of the support nails 40 are located in the soldering notches 18 of the housing 10 for soldering on an external printed circuit board (not shown).

Figure 9:
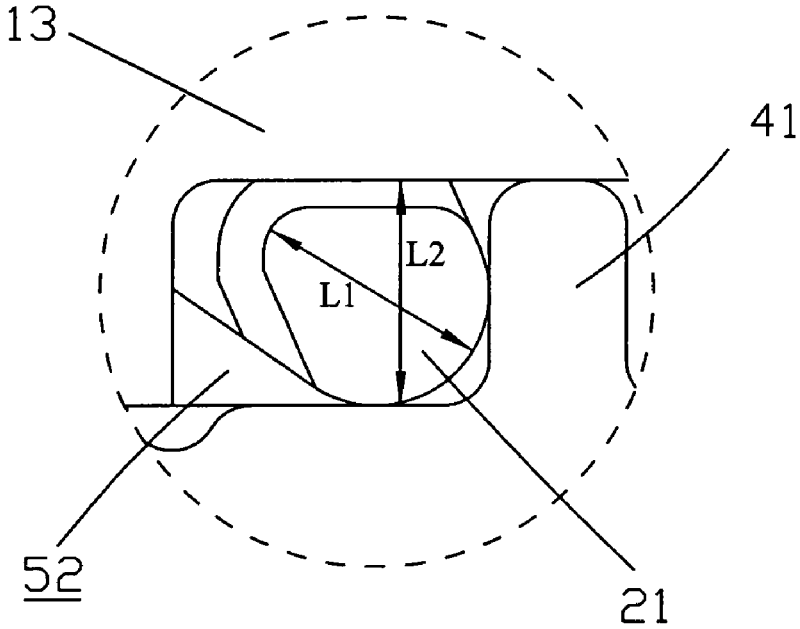
FIG. 9 is an enlarged view of the encircled portion IX of FIG. 8 with the cross-sectional lines removed.

Referring to FIG. 6, a cross section of the cam shaft 21 is illustrated. The cross section of the cam shaft 21 is configured by rebuilding a circle, whose center is designated by O. A portion of the circle is further humped, and two portions of the circle at opposite sides of the humped portion are cut flatly, so that the cross section has an utmost protrudent point A on the humped portion. Accordingly, a chord AB that passes the utmost protrudent point A and the center O is the longest chord of the cross section of the cam shaft 21. As shown in FIGS. 8 and 9, the length of the longest chord AB of each cam shaft 21 designated by L1 is longer than the distance between the upper and the lower inner surfaces of the pivotal hole 52 designated by L2. When the sliding cover 20 is flipped and the cam shaft 21 is rotated in the pivotal hole 52, the utmost protrudent point A of the cam shaft 21 brushes past the upper inner surface of the pivotal hole 52. Therefore, there exists interference between the utmost protrudent point A and the upper inner surface. To flip the sliding cover 20, an intended considerable force should be exerted upon the sliding cover 20 to overcome the interference. As shown in FIG. 7, prior to insertion/release the flexible printed circuit board into/from the connector 100, the sliding cover 20 is firstly flipped up for facilitating the insertion/release operation with zero force. During the insertion/release operation of the flexible printed circuit board, an accidental hit on the sliding cover 20 will not cause the sliding cover 20 to flip down as accidental hit is generally not strong enough to overcome the interference. Therefore, the sliding cover 20 is avoided being accidentally turned over.

Figure 10:
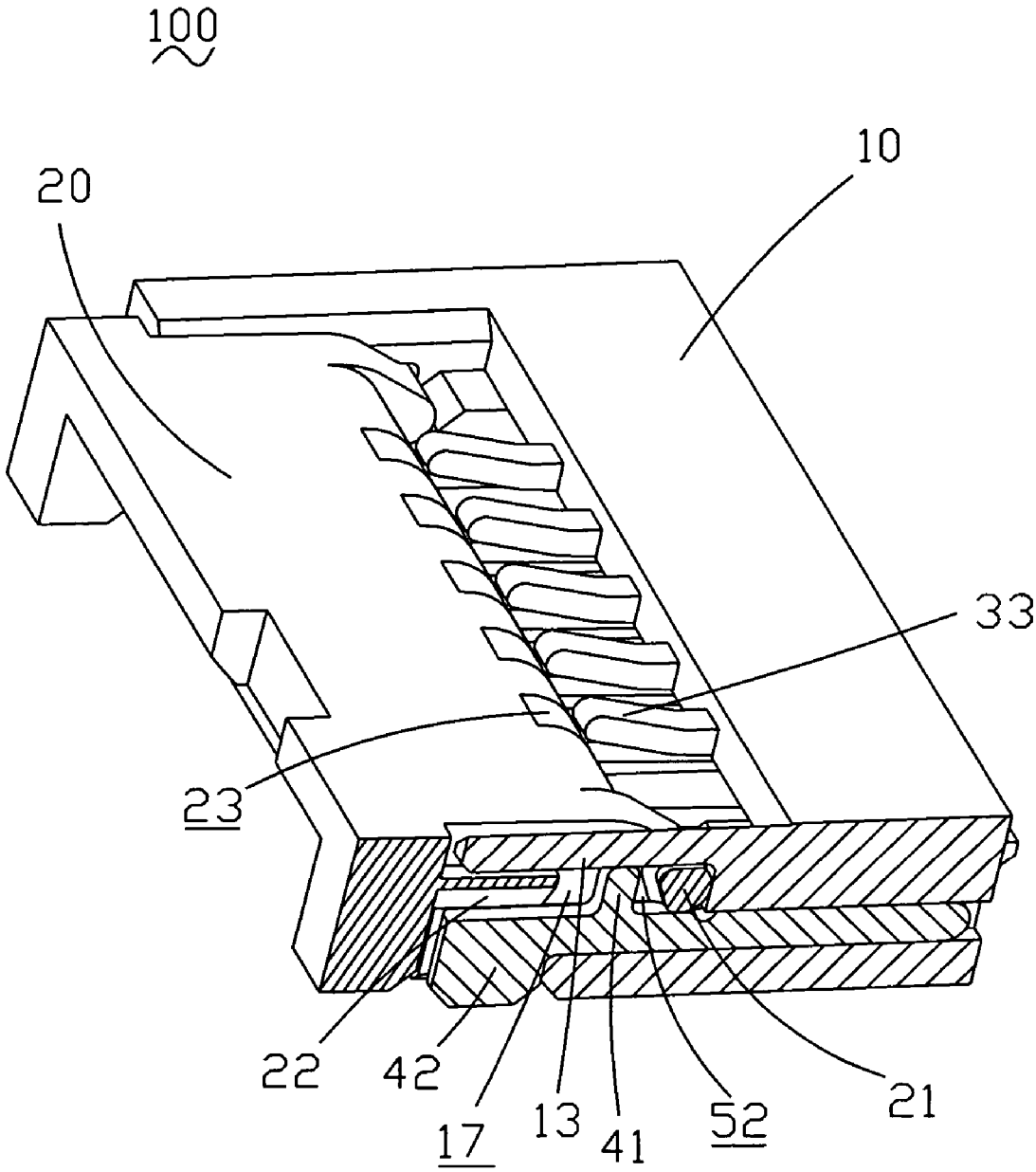
FIG. 10 is a perspective view of the flexible printed circuit board connector with the sliding cover being flipped down and one end of the connector shown in cross-section.
Figure 11:
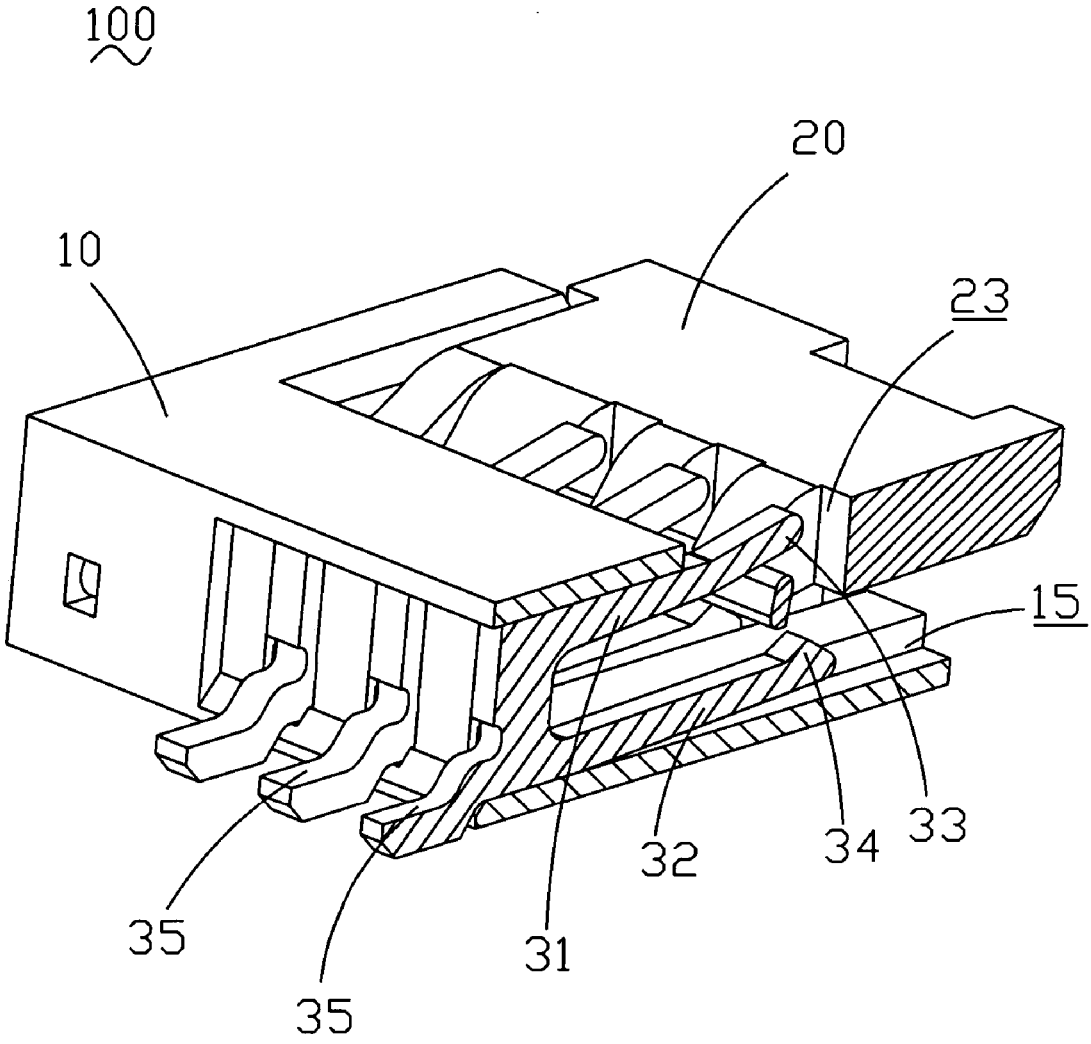
FIG. 11 is another perspective view of the flexible printed circuit board connector with the sliding cover being flipped down and one end of the connector shown in cross-section.

Referring to FIGS. 10 and 11, in the course of assembling the flexible printed circuit connector 100, the flexible printed circuit board is firstly inserted into the board-insertion space 14 of the housing 10 with zero force. The sliding cover 20 is flipped down with the wedges 22 of the sliding cover 20 wedged into the guiding grooves 17 of the housing 10 for locking the sliding cover 20 to the housing 10. Thus the sliding cover 20 is tightly engaged with the housing 10. With the sliding cover 20 pressing upon the flexible printed circuit board and the propping portions 33 of the terminals 30 pressing on the sliding cover 20, the flexible printed circuit board electrically connects the contact portions 34 of the terminals 30.

While the invention has been particularly shown and described with reference to a preferred embodiment thereof, it will be understood by those skilled in the art that the foregoing and other changes in form and details can be made therein without departing from the spirit and scope of the invention.

What is claimed is:

1. A flexible printed circuit board connector for connecting a flexible printed circuit board, the flexible printed circuit board connector comprising:

a housing having a base plate, a bottom plate extending forward from the bottom of the base plate and two sidewalls extending forward from two opposite sides of the base plate, which define a board-insertion space for the flexible printed circuit board to be inserted therein, two guiding grooves being defined in inner sides of the two sidewalls, two insertion holes being defined in the two sidewalls and communicating with the respective guiding grooves;

a plurality of terminals disposed in the housing for electrically connecting the flexible printed circuit board;

a sliding cover having two cam shafts at two opposite sides thereof, the sliding cover being mounted on the housing by sliding the two cam shafts in the guiding grooves and for pressing on the flexible printed circuit board, each of the two cam shafts having a circular cross section with a humped portion having an utmost protrudent point; and a pair of support nails each having a protruding portion, each support nail being inserted in the corresponding insertion hole with the protruding portion extending into the corresponding guiding groove to form a pivotal hole between inner surfaces of the corresponding guiding groove and the protruding portion;

wherein the cam shafts are enclosed and rotatably supported in the respective pivotal holes, the utmost protrudent point of each cam shaft contacts and brushes past an inner surface of the corresponding pivotal hole with interference when the sliding cover is flipped from an up position to a down position, and the utmost protrudent point moves away from the inner surface of the corresponding pivotal hole when the sliding cover is in the up or down position.

2. The flexible printed circuit board connector as claimed in claim 1, wherein the bottom plate defines a plurality of first terminal recesses, the base plate defines a plurality of second terminal recesses corresponding to the respective first terminal recesses, the sliding cover is provided with a plurality of propping recesses on top and back thereof, each terminal has an upper arm and a lower arm respectively received in the corresponding first terminal recess and the corresponding second terminal recess, and the upper arm forms a propping portion at a front end thereof extending into the corresponding propping recess of the sliding cover for urging the sliding cover against the flexible printed circuit board.

3. The flexible printed circuit board connector as claimed in claim 1, wherein the sliding cover has two wedges formed on two opposite sides thereof for being wedged into the guiding grooves to lock the sliding cover to the housing.

* * * * *